US012601347B2

(12) United States Patent
Zhang

(10) Patent No.: US 12,601,347 B2
(45) Date of Patent: Apr. 14, 2026

(54) WATER-LUBRICATED HIGH-PRESSURE PUMP USING ROLLING SUPPORT

(71) Applicant: Shanghai Wave Rider Fluid Technology Co., Ltd., Shanghai (CN)

(72) Inventor: Fan Zhang, Beijing (CN)

(73) Assignee: Shanghai Wave Rider Fluid Technology Co., Ltd., Shanghai (CN)

( * ) Notice: Subject to any disclaimer, the term of this patent is extended or adjusted under 35 U.S.C. 154(b) by 366 days.

(21) Appl. No.: 18/271,310

(22) PCT Filed: Dec. 21, 2021

(86) PCT No.: PCT/CN2021/140070

§ 371 (c)(1),
(2) Date: Jul. 7, 2023

(87) PCT Pub. No.: WO2023/115330

PCT Pub. Date: Jun. 29, 2023

(65) Prior Publication Data

US 2024/0060488 A1 Feb. 22, 2024

(51) Int. Cl.
*F04B 53/18* (2006.01)
*F04B 9/04* (2006.01)
(Continued)

(52) U.S. Cl.
CPC ..... *F04B 53/18* (2013.01); *F04B 9/045* (2013.01); *F04B 53/006* (2013.01); *F04B 53/14* (2013.01)

(58) Field of Classification Search
CPC ..... F04B 53/18; F04B 9/045; F04B 53/006; F04B 53/14; F04B 53/00
See application file for complete search history.

(56) References Cited

U.S. PATENT DOCUMENTS 2,168,850 A * 8/1939 Towler ..... F04B 9/045 74/595
6,183,212 B1 * 2/2001 Djordjevic ..... F04B 1/0426 417/462
2016/0091021 A1 * 3/2016 Yamamoto ..... F16C 33/121 384/276

FOREIGN PATENT DOCUMENTS

CN 201218170 Y 4/2009
CN 203098173 U 7/2013
(Continued)

OTHER PUBLICATIONS

International Search Report for application No. PCT/CN2021/140070 dated Sep. 20, 2022.
(Continued)

*Primary Examiner* — Dominick L Plakkoottam
(74) *Attorney, Agent, or Firm* — Westbridge IP LLC

(57) ABSTRACT

This disclosure discloses a water-lubricated high-pressure pump using rolling support, including a driving mechanism, a shell, a rolling bearing, an isolation structure, at least one plunger and a plunger chamber. The driving mechanism includes a main shaft and at least one eccentric structure, and the main shaft is rotationally connected to the shell through the rolling bearing. The eccentric structure is located in a first inner chamber of the shell, which is configured for filling water or aqueous solution. The rolling bearing is located in a second inner chamber of the shell, and the isolation structure is configured to seal the water or aqueous solution inside the shell to prevent the water or aqueous solution from entering into the second inner chamber. When the eccentric structure is rotated, the eccentric structure can push the plunger to move in the plunger chamber to realize pressurization of the water or aqueous solution.

6 Claims, 6 Drawing Sheets

(51) Int. Cl.
*F04B 53/00* (2006.01)
*F04B 53/14* (2006.01)

(56) References Cited

FOREIGN PATENT DOCUMENTS

| | | | | | |
|---|---|---|---|---|---|
| CN | 104454420 | A | | 3/2015 | |
| CN | 104696212 | A | | 6/2015 | |
| CN | 204511865 | U | * | 7/2015 | |
| CN | 105240237 | A | * | 1/2016 | |
| CN | 205154522 | U | * | 4/2016 | |
| CN | 104696212 | B | * | 1/2017 | |
| CN | 108266429 | A | | 7/2018 | |
| CN | 111927726 | A | * | 11/2020 | ..... F04B 1/00 |
| CN | 112412722 | A | * | 2/2021 | ..... F04B 1/0461 |
| CN | 214035951 | U | | 8/2021 | |
| JP | S5655781 | U | | 5/1981 | |
| JP | H03102070 | U | | 10/1991 | |
| JP | H08254185 | A | | 10/1996 | |
| JP | H0972295 | A | | 3/1997 | |
| JP | H10288146 | A | | 10/1998 | |
| JP | 2005127225 | A | | 5/2005 | |
| JP | 2013155627 | A | | 8/2013 | |

OTHER PUBLICATIONS

First Office Action issued in counterpart Japanese Patent Application No. 2024-538104, dated Aug. 5, 2025.
Decision to Grant a Patent issued in counterpart Japanese Patent Application No. JP 2024-538104, dated Dec. 9, 2025.

* cited by examiner

WATER-LUBRICATED HIGH-PRESSURE PUMP USING ROLLING SUPPORT

CROSS-REFERENCE TO RELATED APPLICATIONS

This application is a national stage application of International Patent Application No. PCT/CN2021/140070, filed on Dec. 21, 2021, which is incorporated by references in their entities.

TECHNICAL FIELD

The disclosure relates to the technical field of high-pressure water pumps which can be lubricated by water or a aqueous solution.

BACKGROUND ART

High-pressure water pumps are used for producing high-pressure water. As a core component, they are widely used in high-pressure cleaning, fine mist fire extinguishing, spraying, seawater desalination, deburring of mechanical parts and other fields.

The high-pressure water pumps widely used at present include a reciprocating pump and a water-lubricated axial plunger pump.

The reciprocating pump has a long history, is widely used in the production of high-pressure water, and is mainly composed of a crankshaft, connecting rods, crossheads, plungers and other components. Lubricating oil is used for lubricating the power end, and contact sealing is needed for sealing pressurized water and meanwhile isolating water and lubricating oil. The main problems of this type of pump are that the lubricating oil needs to be replaced regularly, and the lubricating oil can pollute the environment, and the sealing has a short service life and is troublesome to replace.

In the 1990s, a commercial water-lubricated axial plunger pump is successfully provided by Danfoss as a representative. Compared with the reciprocating pump, the water-lubricated axial plunger pump has the advantages of environmental protection, high energy efficiency and the like. The main moving parts are supported by hydrostatic pressure, achieving the maximum pressure output of 16 MPa. In addition, the Chinese patent with publication number CN105240237A proposes a water-lubricated plunger pump.

The high-pressure water pump realized by the power-end water lubrication technology has environmental protection and high efficiency, and is undoubtedly an important development direction for the high-pressure water pump. However, the viscosity of water is low, the high-performance materials suitable for water are limited, and it is difficult to design and match the friction pair, so that the water-lubricated high-pressure water pump with higher pressure, strong environmental adaptability and good economy has not been commercially realized yet.

One of important specific issues that restrict the development of high-pressure water pumps with power-end water lubrication is the support for the main shaft. Under the condition of loads, the camshaft or crankshaft can produce flexure deformation, so the supports at both ends of the main shaft of traditional oil-lubricated machinery generally adopt rolling bearings, which are relatively adapted to flexure deformation. Under the condition of water environment, economic bearing steel materials such as GCr15 cannot withstand corrosion. Since the lack of lubrication, and the contact fatigue strength of traditional stainless steel materials is far from ensuring the long-life service requirements, no economical rolling bearing can satisfy the high-strength service requirements in the water environment except expensive ceramic rolling bearings. In addition, the sliding bearing has a long life and can resist corrosion, however, it is sensitive to the flexure deformation of the shaft, and is more difficult to use especially for low viscosity fluid environment conditions. For this reason, in the document CN105240237A, hydrostatic support has to be adopted for the main shaft support of the water pump, which significantly increases the structural complexity and brings problems such as high-pressure fluid leakage and pollutant sensitivity.

SUMMARY

The disclosure aims to provide a water-lubricated high-pressure pump using rolling support, so that the main shaft of the existing high-pressure water pump can be supported economically and reliably under the condition of apparent flexure deformation.

In order to achieve the above purpose, the disclosure provides the following scheme.

This disclosure provides a water-lubricated high-pressure pump using rolling support, including a driving mechanism, a shell, a rolling bearing, an isolation structure, at least one plunger and at least one plunger chamber corresponding to the at least one plunger one by one, wherein the driving mechanism includes a main shaft and at least one eccentric structure arranged on the main shaft, and the main shaft is on at least one side thereof rotationally connected to the shell through the rolling bearing; the at least one eccentric structure is located in a first inner chamber of the shell, and the first inner chamber of the shell is configured to receive water or an aqueous solution; the rolling bearing is located in a second inner chamber of the shell, and the isolation structure is configured to seal the water or aqueous solution inside the shell from entering into the second inner chamber; and when the at least one eccentric structure is rotated, the at least one eccentric structure can push the at least one plunger to move in the plunger chamber to realize pressurization of the water or aqueous solution.

Preferably, the isolation structure is designed to be as a sealing structure, and the sealing structure is designed to be as a contact sealing structure.

Preferably, the rolling bearing is lubricated with grease.

Preferably, a thrust structure is sleeved on an outer side of each eccentric structure, the thrust structure is located in the first inner chamber of the shell, the thrust structure and the corresponding eccentric structure can be rotated relative to each other, and the thrust structure and the corresponding eccentric structure constitute a first sliding friction pair. The water or aqueous solution can enter the first sliding friction pair in the first inner chamber. When the at least one eccentric structure is rotated, the thrust structure can push the at least one plunger to move in the plunger chamber to realize the pressurization of the water or aqueous solution.

Preferably, an outer edge curve of a cross section of the thrust structure perpendicular to an axis of the main shaft includes a first curve and a second curve, perpendicular distances from points on the first curve to the axis of the main shaft gradually increase from one end of the first curve to an other end of the first curve, and perpendicular distances from points on the second curve to the axis of the main shaft gradually decrease from one end of the second curve, which is connected to said other end of the first curve, to an other end of the second curve, which is connected to said one end of the first curve.

Preferably, a first anti-friction layer is provided on an outer surface of each eccentric structure and/or an inner surface of the thrust structure; and the first anti-friction layer is made of plastic.

Preferably, the at least one plunger each includes a plunger body, one end of the plunger body extends into the plunger chamber, the plunger body and the plunger chamber constitute a second friction pair, a second anti-friction layer is fixed on an outer surface of the plunger body and/or an inner surface of the plunger chamber; and the second anti-friction layer is made of plastic.

Preferably, a drainage chamber is arranged between the isolation structure and the rolling bearing, a water retaining ring is arranged in the drainage chamber, the water retaining ring is sleeved on the main shaft, the drainage chamber is communicated with a fluid channel of the shell, and the water or aqueous solution inside the drainage chamber is discharged to the outside of the shell through the fluid channel.

Preferably, the thrust structure can roll on a contact surface of the plunger with the thrust structure, and can push the plunger to move in the plunger chamber to realize the pressurization of the water or aqueous solution.

This disclosure obtains the following technical effects over the prior art.

The driving mechanism of the high-pressure water pump in accordance with this disclosure adopts water and aqueous solution to realize lubrication, and at the same time, the water and aqueous solution can effectively solve the heat dissipation problem of the friction pair. The isolation structure isolates a space (the second inner chamber) in the shell where the rolling bearing is located, which avoids the influence of the water or aqueous solution on the rolling bearing, makes it possible for the support structure of the main shaft to adopt the economical traditional rolling bearing, and solves the problem that the main shaft of the high-pressure water pump suffers from flexural deflection. At the same time, the shell corresponding to the second inner chamber where the rolling bearing is located can transfer the heat generated by the operation of the rolling bearing to the water or water solution, thus avoiding the accumulation of heat and enabling the high-pressure water pump to work continuously for a long time under high load conditions. The driving mechanism of the high-pressure water pump in accordance with the disclosure does not use lubricating oil, and it is not necessary to regularly replace the lubricating oil for maintenance, and the output pressure exceeds 30 MPa, which is also of positive significance to environmental protection. The supporting structure of the main shaft of the disclosure adopts the traditional rolling bearing, which avoids hydrostatic pressure support, has a simple structure, good economy, no flow loss, helps the high-pressure water pump to achieve higher pressure and volumetric efficiency, and significantly improves the anti-pollution ability.

BRIEF DESCRIPTION OF THE DRAWINGS

In order to illustrate more clearly embodiments of the present disclosure or technical schemes in the prior art, the accompanying drawings required in the embodiments will be briefly described below. Apparently, the accompanying drawings in the description described below are only some embodiments of the present disclosure, and it is clear for those skilled in the art that other drawings can be obtained based on the drawings without creative efforts.

REFERENCE NUMERALS

Figure 1:
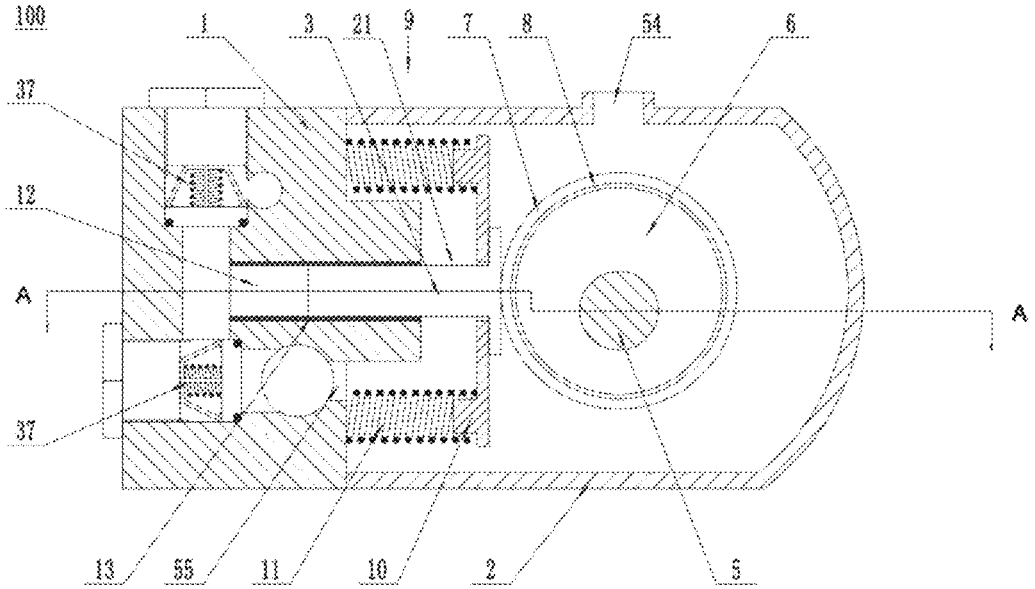
FIG. 1 is a schematic diagram of an internal structure of a water-lubricated high-pressure pump using rolling support (Embodiment one) in accordance with the present disclosure.

100 water-lubricated high-pressure pump using rolling support, 1 liquid cylinder body, 2 shell, 3 plunger body, 4 driving mechanism, 5 main shaft, 6 cam, 7 thrust structure, 8 first anti-friction layer, 9 resilience structure, 10 first baffle, 11 first elastic element, 12 plunger chamber, 13 second anti-friction layer, 14 isolation structure, 15 water retaining ring, 16 elastic retaining ring, 17 rolling bearing, 18 first inner chamber, 19 second inner chamber, 20 drainage chamber, 21 plunger, 22 first curve, 23 second curve, 24 fluid channel, 25 axis of the main shaft, 26 one end of the first curve, 27 other end of the first curve; 28 one end of the second curve; 29 other end of the second curve, 30 perpendicular distance from a point on the first curve to the axis of the main shaft, 31 perpendicular distance from a point on the second curve to the axis of the main shaft, 32 eccentric structure, 35 connecting rod journal, 36 crank, 37 one-way valve, 54 water inlet of shell, 55 water inlet of liquid cylinder body.

DETAILED DESCRIPTION OF THE EMBODIMENTS

The technical solutions in the embodiments of the present disclosure will be clearly and completely described below with reference to the accompanying drawings in the embodiments of the present disclosure. Apparently, the described embodiments are only parts of the embodiments of the present disclosure, and not all of the embodiments. All other embodiments, which can be obtained by those skilled in the art without creative effort based on the embodiments of the present disclosure, fall within the scope of the present disclosure.

The disclosure aims to provide a water-lubricated high-pressure pump using rolling support, so that the main shaft of the existing high-pressure water pump can be supported economically and reliably under the condition of apparent flexure deformation.

In order to make the aforementioned objects, features and advantages of the present disclosure clearer and more comprehensible, the present disclosure is further described in detail with reference to the accompanying drawings and the detailed description thereof.

Embodiment One

As shown in FIGS. 1-6, the present embodiment provides a water-lubricated high-pressure pump using rolling support 100, including a driving mechanism 4, a liquid cylinder body 1, resilience structures 9, rolling bearing 17, at least one plunger 21 and one plunger chamber 12. The liquid cylinder body 1 is also called as pump head, has the same function as the liquid cylinder body of the existing reciprocating pump, and is one of the parts mainly bearing hydraulic pressure in the pump. High and low pressure fluid channels and one-way valves 37 are arranged in the liquid cylinder body 1, and one plunger 21 corresponds to one suction valve and one discharge valve to realize the distribution of fluid, thereby realizing the inflow of low-pressure water and the outflow of high-pressure water. The plunger chamber 12 can be arranged on the liquid cylinder body 1 or the shell 2, and the liquid cylinder body 1 can be integrally processed and formed, or can be combined by multiple components. The shell 2 is fixedly connected to a right end of the liquid cylinder body 1, and the liquid cylinder body 1 and the shell 2 are detachably connected or integrally formed. The shell 2 can also be formed by combining and fixing multiple parts. The driving mechanism 4 includes a main shaft 5 and at least one eccentric structure 32 arranged on the main shaft 5. In the present embodiment, the eccentric structure 32 is designed as a cam 6, preferably in the form of an eccentric wheel. The main shaft 5 is on at least one side thereof rotationally connected to the shell 2 through the rolling bearing 17, an inner ring of the rolling bearing 17 is sleeved on the main shaft 5, and an outer ring of the rolling bearing 17 is sleeved inside the shell 2. The rolling bearing 17 is preferably lubricated with grease.

A thrust structure 7 is sleeved on an outer side of each cam 6, the thrust structure 7 and the cam 6 can be rotated relative to each other, and the thrust structure 7 and the cam 6 constitute a first sliding friction pair. An outer edge curve of a cross section of the thrust structure 7 perpendicular to the axis of the main shaft 25 includes a first curve 22 and a second curve 23. The perpendicular distances from points on the first curve 22 to the axis of the main shaft 25 gradually increase from one end of the first curve 26 to an other end of the first curve 27, and the perpendicular distances from points on the second curve 23 to the axis of the main shaft 25 gradually decrease from one end of the second curve 28 connected to said other end of the first curve 27 to an other end of the second curve 29 connected to said one end of the first curve 26.

The cam 6 and the thrust structure 7 are both located in a first inner chamber 18 of the shell 2, and the rolling bearing 17 is located in a second inner chamber 19 of the shell 2, an isolation structure 14 is arranged between the first inner chamber 18 and the second inner chamber 19. The first inner chamber 18 is used to fill water or an aqueous solution which can enter the first sliding friction pair, so that the lubrication and heat dissipation of the first sliding friction pair can be improved through the water or aqueous solution. When the eccentric structure 32 is rotated, the thrust structure 7 can push the plunger 21 to move in the plunger chamber 12 to realize pressurization of the water or aqueous solution. A left end of each plunger 21 is located in the liquid cylinder body 1, a right end of each plunger 21 is in contact with the thrust structure 7, and the plunger 21 is provided with a resilience structure 9. One end of the main shaft 5 is connected with a power equipment (such as a motor). When the main shaft 5 drives the cam 6 to rotate, the thrust structure 7 can push the plunger 21 through contact to move in the plunger chamber 12 of the liquid cylinder body 1 towards the direction of the liquid cylinder body 1 while rolling on the contact surface of the plunger 21 with the thrust structure 7 (there may be partial sliding), so that the pressurization on the water or aqueous solution is realized, and the water or aqueous solution is discharged. Then, through an action of the resilience structure 9, it is ensured that during a return stroke of the plunger 21, the plunger 21 keeps contact with thrust structure 7 and water is sucked.

Figure 2:
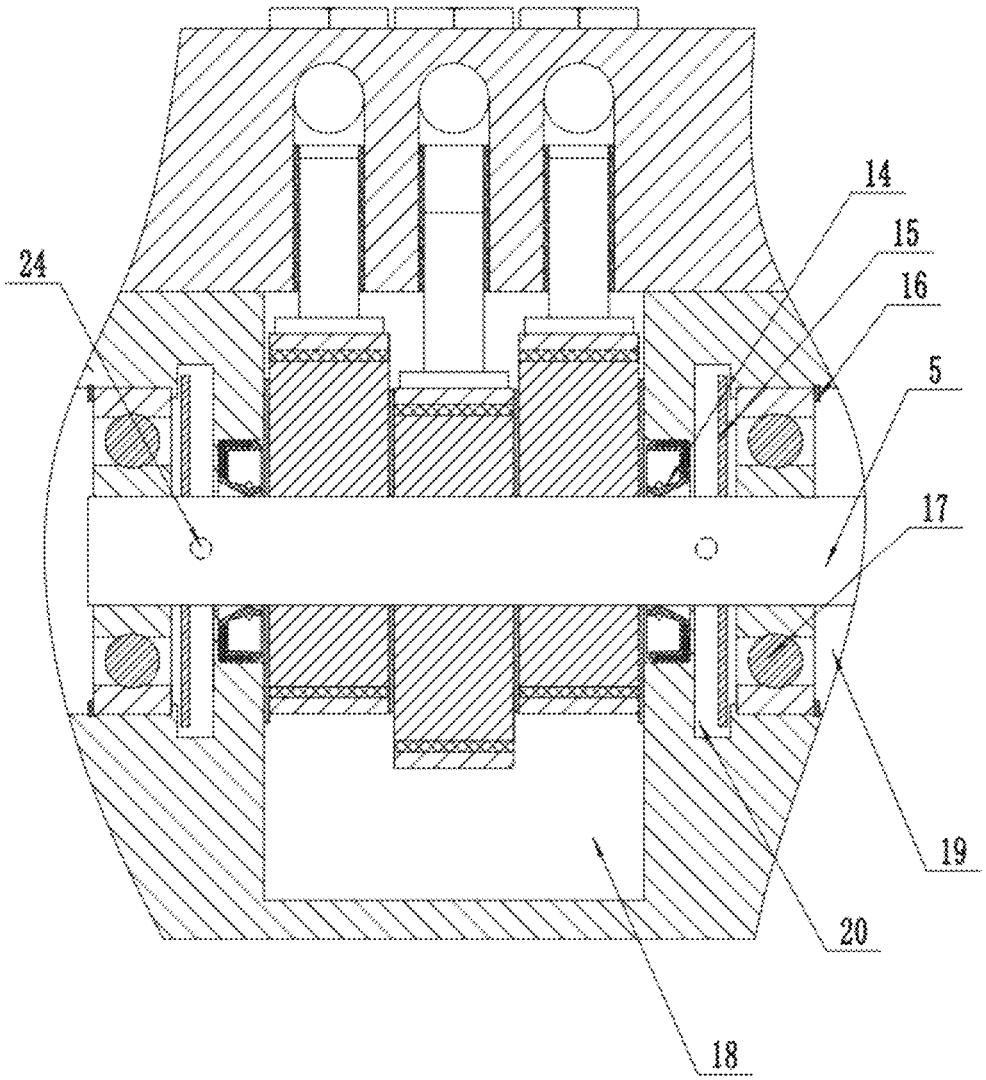
FIG. 2 is an A-A sectional view of FIG. 1 (a first example of an isolation structure of Embodiment one adopting an oil seal structure) in accordance with the present disclosure.
Figure 3:
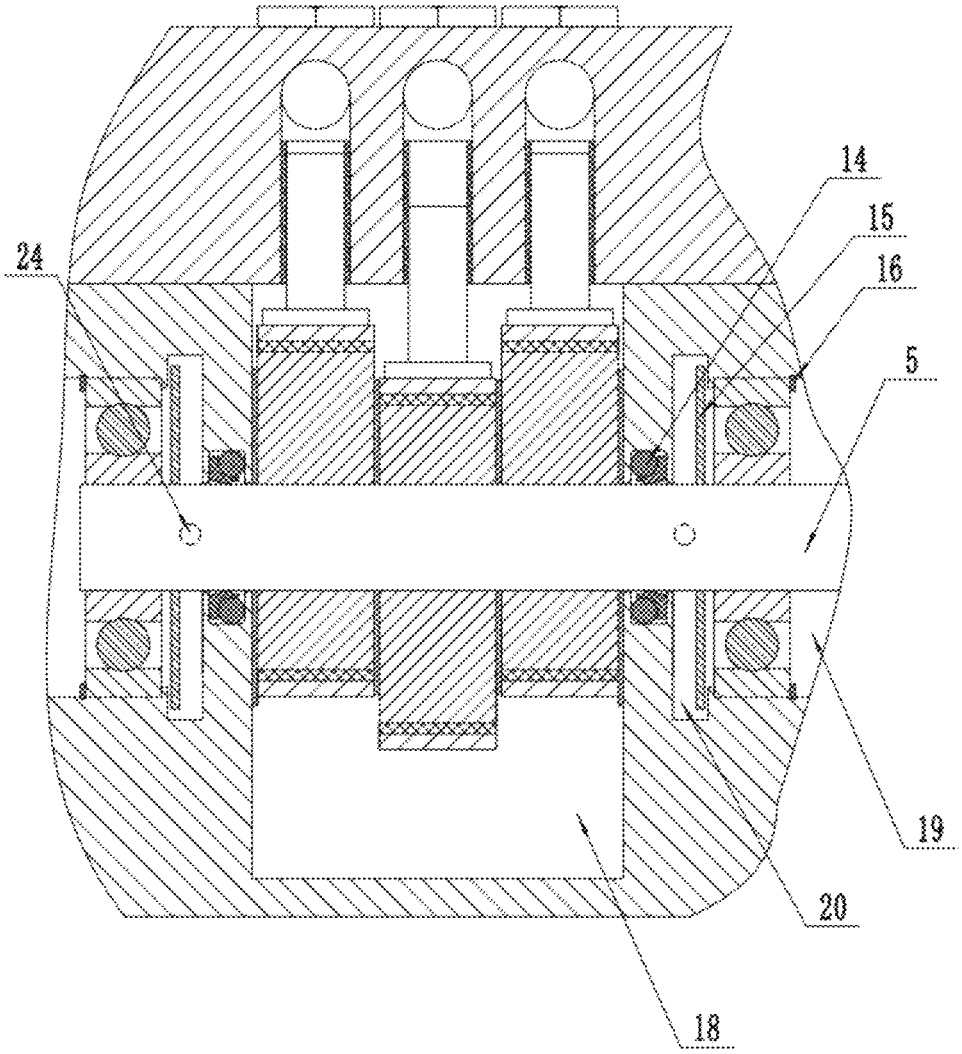
FIG. 3 is an A-A sectional view of FIG. 1 (a second example of the isolation structure of Embodiment one adopting a lip seal structure with compensation function) in accordance with the present disclosure.
Figure 4:
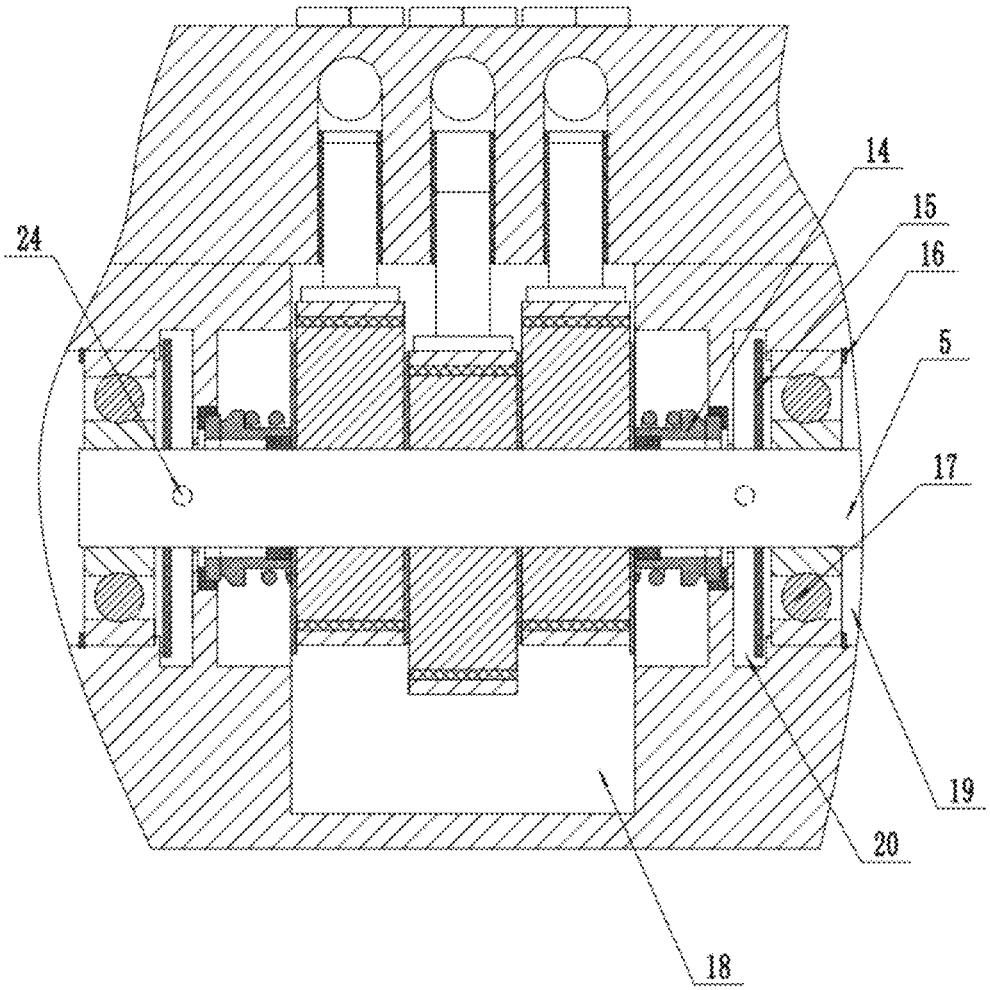
FIG. 4 is an A-A sectional view of FIG. 1 (a third example of the isolation structure of Embodiment one adopting a mechanical sealing structure) in accordance with the present disclosure.
Figure 5:
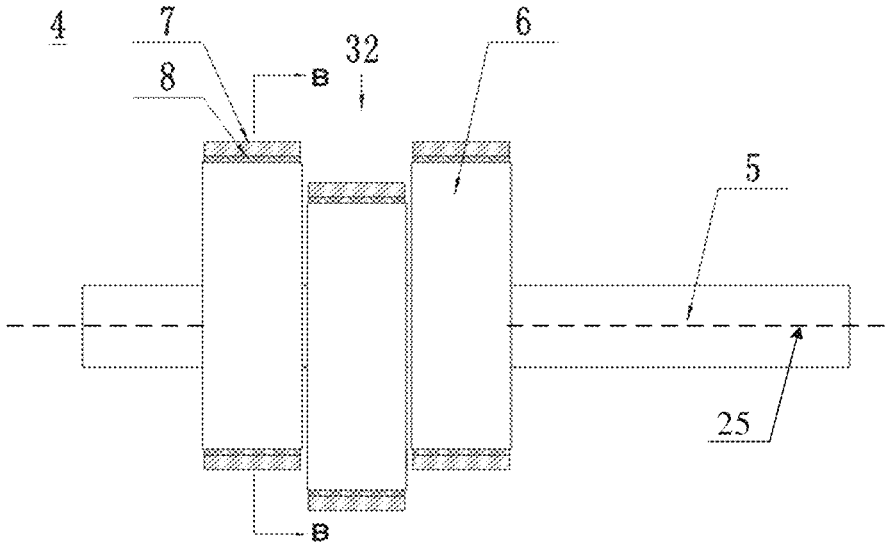
FIG. 5 is a first schematic diagram of a driving mechanism (Embodiment one) in accordance with the present disclosure.
Figure 6:
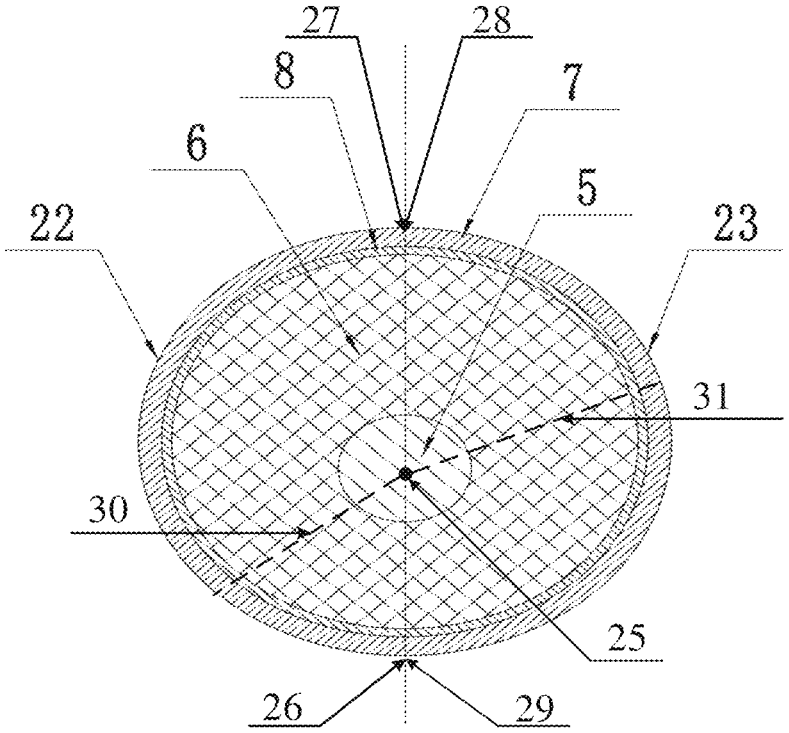
FIG. 6 is a B-B sectional view of FIG. 5 (Embodiment one).

As shown in FIGS. 2-4, the isolation structure 14 isolates the space of the first inner chamber 18 where the eccentric structure 32 is located from the space of the second inner chamber 19 where the rolling bearing 17 is located. The isolation structure 14 is installed between the shell 2 and the main shaft 5, and is located between the outermost eccentric structure 32 and the rolling bearing 17, and an outer side of the rolling bearing 17 is provided with an elastic retaining ring 16. The isolation structure 14 can prevent the water in the first inner chamber 18 in the shell 2 from entering the installation space of the rolling bearing 17 of the second inner chamber 19, and the isolation structure 14 can be chosen as an oil seal structure, a lip seal structure with compensation function, or a mechanical seal structure. In operation, because it is difficult for the existing contact sealing structure to completely seal water, a little amount of water or aqueous solution may enter the second inner chamber 19 from the first inner chamber 18 through the isolation structure 14. In order to prevent water or aqueous solution from eroding the rolling bearing 17, a water retaining ring 15 is fixed on the main shaft 5 between the isolation structure 14 and the rolling bearing 17, and the water retaining ring 15 is located in a drainage chamber 20 which is provided with a fluid channel 24 to the outside of the shell 2. The water retaining ring 15 can further prevent the leaked water or aqueous solution from reaching the rolling bearing 17 along the axial direction, and at the same time, the leaked water or aqueous solution can be discharged from the drainage chamber 20 to the outside of the shell 2 through the fluid channel 24, so as to ensure that the rolling bearing 17 is completely isolated from the water or aqueous solution. The contact seal structure is a vulnerable part, and the arrangement of the water retaining ring 15 and the drainage chamber 20 also helps to protect the rolling bearing 17 when the contact seal is damaged.

In the present embodiment, a first anti-friction layer 8 is provided on an outer surface of the cam 6 and/or an inner surface of the thrust structure 7. The first anti-friction layer 8 can be specifically fixed with the cam 6 or the thrust structure 7 through bonding and interference fit, or can be directly formed on the surface by processes such as direct injection molding and spraying. The water or aqueous solution enters the first sliding friction pair to generate a fluid dynamic pressure lubrication effect.

The first anti-friction layer 8 is made of plastic, preferably a thermoplastic material, such as polyether ether ketone, polyphenylene sulfide, polyamide, polyarylether, etc., and the tribological properties can be effectively improved by adding fiber, graphite, polytetrafluoroethylene and the like into the plastic.

In the present embodiment, the cam 6 and the main shaft 5 can be manufactured as an integral part, or can be manufactured in separate parts and then be assembled and fixed, so that the cam 6 and the main shaft 5 rotate synchronously. Each thrust structure 7 is sleeved on a corresponding cam 6 respectively. In the present embodiment, three cams 6 are arranged on the main shaft 5, each cam 6 can push one plunger 21 to pressurize the water or aqueous solution, and the three cams 6 have a phase difference of 120 degrees from each other in the rotational direction.

The plunger 21 can be composed of a single part or a combination of multiple parts. In the present embodiment, the plunger 21 includes the plunger body 3. The plunger bodies 3 are all arranged on one side of the main shaft 5, so that the structure can be simplified, and is convenient to manufacture. One end of the plunger body 3 extends into the plunger chamber 12 of the liquid cylinder body 1, the plunger body 3 and the plunger chamber 12 constitute a second friction pair. A gap of 1 μm-30 μm is arranged in the second friction pair, and the gap ensures that the plunger body 3 moves smoothly in the plunger chamber 12 and inhibits high-pressure fluid in the plunger chamber 12 from leaking to a low-pressure end at the same time, and the water or aqueous solution plays a role of lubricating the friction pair in the gap while taking away friction heat.

In the present embodiment, a second anti-friction layer 13 is fixed on an outer surface of the plunger body 3 and/or an inner surface of the plunger chamber 12. The second anti-friction layer 13 is made of plastic, preferably a thermoplastic material, such as polyether ether ketone, polyphenylene sulfide, polyamide, polyarylether, etc., and the tribological properties can be effectively improved by adding fiber, graphite, polytetrafluoroethylene and the like into the plastic.

In the present embodiment, the second anti-friction layer 13 can be fixed to the outer surface of the plunger body 3 or the inner surface of the plunger chamber 12 by bonding or interference fit, or can be directly formed on the surface of the second friction pair by injection molding or spraying.

In the present embodiment, the resilience structure 9 includes a first baffle 10 and a first elastic element 11. The first baffle 10 is fixed to a right end of the plunger body 3, one end of the first elastic element 11 abuts against the hydraulic cylinder 1, and the other end of the first elastic element 11 abuts against the first baffle 10.

The present embodiment has a simple structure, the driving mechanism 4 does not need lubricating oil, and the maintenance is convenient, and the pressure output exceeding 30 MPa can be realized.

Embodiment Two

Figure 7:
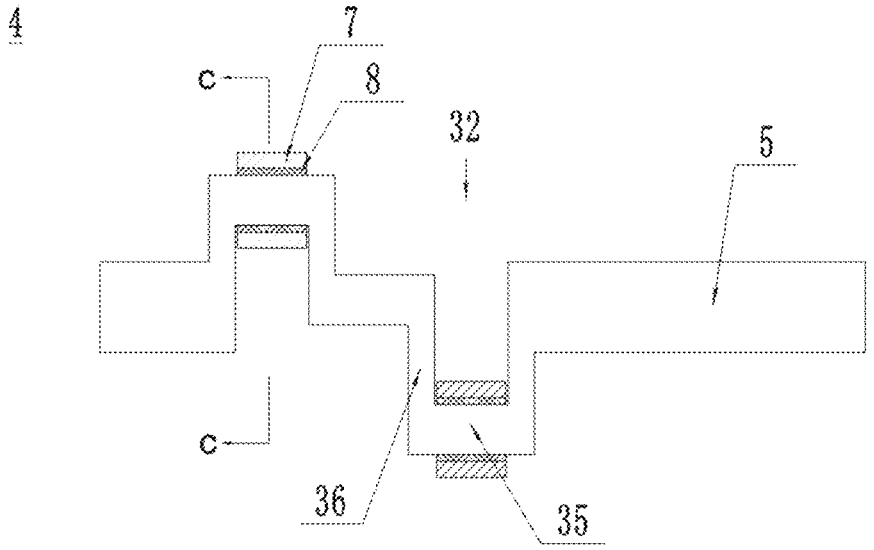
FIG. 7 is a second schematic diagram of the driving mechanism (Embodiment two) in accordance with the present disclosure.
Figure 8:
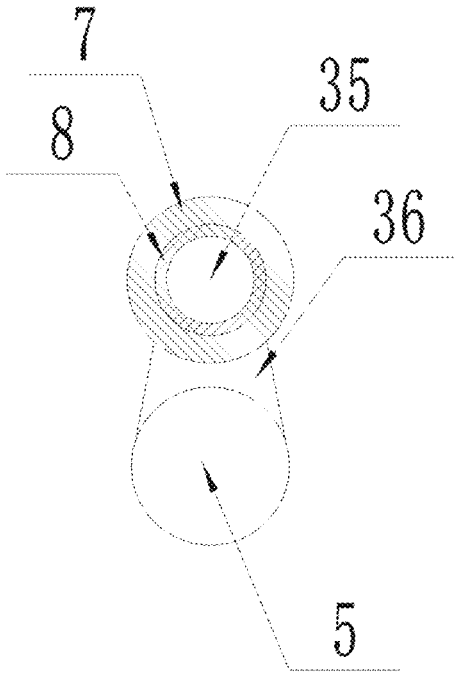
FIG. 8 is a C-C sectional view of FIG. 7 (Embodiment two).

As shown in FIGS. 7-8, a difference between the present embodiment and Embodiment one is that: in the present embodiment, the eccentric structure 32 is a crankshaft, the connecting rod journals 35 are connected to the main shaft 5 through cranks 36, the thrust structure 7 is sleeved on the peripheries of the connecting rod journals 35, and the first anti-friction layers 8 are disposed on the outer surfaces of the connecting rod journals 35 and/or the inner surfaces of the thrust structure 7.

The principle and the implementation mode of the present disclosure are explained by applying specific examples in the present specification, and the descriptions of the above embodiments are only used to help understanding the method and the core idea of this disclosure; meanwhile, for those skilled in the art, according to the idea of the present disclosure, the specific embodiments and the application range can be changed. In conclusion, the contents of this specification should not be construed as limiting this disclosure.

What is claimed is:

1. A water-lubricated high-pressure pump using rolling support, comprising a driving mechanism, a shell, a rolling bearing, an isolation structure, at least one plunger and at least one plunger chamber corresponding to the at least one plunger one by one, wherein the driving mechanism comprises a main shaft and at least one eccentric structure arranged on the main shaft, and the main shaft is on at least one side thereof rotationally connected to the shell through the rolling bearing; the at least one eccentric structure is located in a first inner chamber of the shell, and the first inner chamber of the shell is configured to receive water or an aqueous solution; the rolling bearing is located in a second inner chamber of the shell, and the isolation structure is configured to seal the water or aqueous solution inside the shell from entering into the second inner chamber; and when the at least one eccentric structure is rotated, the at least one eccentric structure can push the at least one plunger to move in the plunger chamber to realize pressurization of the water or aqueous solution;

wherein a thrust structure is sleeved on an outer side of each eccentric structure, the thrust structure is located in the first inner chamber of the shell, the thrust structure and the eccentric structure are rotated relative to each other, and the thrust structure and the eccentric structure constitute a first sliding friction pair; the water or the aqueous solution enters into the first sliding friction pair in the first inner chamber; and when the at least one eccentric structure is rotated, the thrust structure abuts against a contact surface of the plunger and rolls on the contact surface, to push the at least one plunger to move in the plunger chamber to realize the pressurization of the water or the aqueous solution;

wherein a drainage chamber is arranged between the isolation structure and the rolling bearing, the drainage chamber communicates with a fluid channel of the shell, and the water or the aqueous solution inside the drainage chamber is discharged to an outside of the shell through the fluid channel;

wherein the rolling bearing is lubricated with grease.

2. The water-lubricated high-pressure pump using rolling support according to claim 1, wherein the isolation structure is designed to be as a sealing structure, and the sealing structure is designed to be as a contact sealing structure.

3. The water-lubricated high-pressure pump using rolling support according to claim 1, wherein an outer edge curve of a cross section of the thrust structure perpendicular to an axis of the main shaft comprises a first curve and a second curve, perpendicular distances from points on the first curve to the axis of the main shaft gradually increase from one end of the first curve to an other end of the first curve, and perpendicular distances from points on the second curve to the axis of the main shaft gradually decrease from one end of the second curve, which is connected to said other end of the first curve, to an other end of the second curve, which is connected to said one end of the first curve.

4. The water-lubricated high-pressure pump using rolling support according to claim 3, wherein a first anti-friction layer is provided on an outer surface of each eccentric structure and/or an inner surface of the thrust structure; and the first anti-friction layer is made of plastic.

5. The water-lubricated high-pressure pump using rolling support according to claim 2, wherein the at least one plunger each comprises a plunger body, one end of the plunger body extends into the plunger chamber, the plunger body and the plunger chamber constitute a second friction pair, a second anti-friction layer is fixed on an outer surface of the plunger body and/or an inner surface of the plunger chamber; and the second anti-friction layer is made of plastic.

6. The water-lubricated high-pressure pump using rolling support according to claim 1, wherein the thrust structure can roll on the contact surface of the plunger with the thrust structure, and can push the plunger to move in the plunger chamber to realize the pressurization of the water or aqueous solution in the plunger chamber to be discharged.

* * * * *